US011953014B2

(12) United States Patent
Kim et al.

(10) Patent No.: US 11,953,014 B2
(45) Date of Patent: Apr. 9, 2024

(54) INTEGRATED WATER PUMP AND VALVE DEVICE

(71) Applicant: GMB KOREA CORP., Gyeongsangnam-do (KR)

(72) Inventors: Kyung Hwan Kim, Incheon (KR); Chang Hyun Park, Gyeonggi-do (KR); Jae Sung Bae, Gyeonggi-do (KR)

(73) Assignee: GMB KOREA CORP., Gyeongsangnam-Do (KR)

( * ) Notice: Subject to any disclaimer, the term of this patent is extended or adjusted under 35 U.S.C. 154(b) by 0 days.

(21) Appl. No.: 18/276,184

(22) PCT Filed: Feb. 9, 2022

(86) PCT No.: PCT/KR2022/001978
§ 371 (c)(1),
(2) Date: Aug. 7, 2023

(87) PCT Pub. No.: WO2022/173219
PCT Pub. Date: Aug. 18, 2022

(65) Prior Publication Data

US 2024/0035477 A1 Feb. 1, 2024

(30) Foreign Application Priority Data

Feb. 9, 2021 (KR) ..... 10-2021-0018477

(51) Int. Cl.
*F04D 15/00* (2006.01)
*F04D 29/42* (2006.01)

(52) U.S. Cl.
CPC ..... *F04D 15/0005* (2013.01); *F04D 29/426* (2013.01)

(58) Field of Classification Search
CPC ..... F04D 15/0005; F04D 29/426
See application file for complete search history.

(56) References Cited

U.S. PATENT DOCUMENTS

2017/0321812 A1* 11/2017 Jang ..... F16K 5/205
2021/0010477 A1* 1/2021 Blad ..... F24D 3/105

FOREIGN PATENT DOCUMENTS

| | | | |
|---|---|---|---|
| JP | 2009047051 | A | 3/2009 |
| JP | 2017067194 | A | 4/2017 |
| JP | 2020051548 | A | 4/2020 |
| KR | 20100102939 | A | 9/2010 |
| KR | 1020170018026 | | 12/2018 |
| KR | 102192901 | B1 * | 12/2020 |

OTHER PUBLICATIONS

International Search Report dated Jul. 8, 2022.

* cited by examiner

*Primary Examiner* — Audrey B. Walter
(74) *Attorney, Agent, or Firm* — Dickinson Wright PLLC

(57) ABSTRACT

An integrated water pump and valve device in which a water pump and a valve are integrally controlled by a single controller, and the water pump and the valve are integrated, thereby reducing an overall size.

17 Claims, 12 Drawing Sheets

INTEGRATED WATER PUMP AND VALVE DEVICE

RELATED APPLICATIONS

The present disclosure is a national phase application of PCT Application PCT/KR2022/001978, filed Feb. 9, 2022, which claims priority to Korean Application KR 10-2021-0018477, filed on Feb. 9, 2021, the entire contents of which is incorporated herein by reference.

FIELD

The present invention relates to an integrated water pump and valve device in which a water pump and a valve are modularized and share a single controller.

BACKGROUND

An electric vehicle refers to a vehicle that obtains vehicle driving energy from electrical energy instead of combustion of fossil fuel, unlike a vehicle in the related art. The advantage of the electric vehicle is that no exhaust gas is emitted, and very little noise occurs. The electric vehicle has not been practical because of issues such as a heavy weight of a battery and a large amount of charging time. However, recently, the development of the electric vehicle has accelerated as problems of severe pollution and depletion of fossil fuel have been raised.

In general, the electric vehicle, which is driven by a motor, includes an inverter, a charger, and an LDC for covering direct current power into alternating current power. A cooling system is essentially required to always maintain an appropriate temperature to cope with heat generation properties of the above-mentioned components.

To this end, the cooling system is equipped with a water pump to circulate a coolant. The coolant discharged from the water pump flows through a motor and electric devices related to the motor and then circulates via a heat source, such that various types of electric devices having heat generation properties are protected from an excessive temperature.

However, in the related art, the water pump and a valve are separately provided, and the water pump and the valve are controlled by separate controllers, which we have discovered causes a problem in which a structure is complicated, and an overall size is increased.

As the related art, there is KR 10-2010-0102939 A.

The foregoing explained as the background is intended merely to aid in the understanding of the background of the present invention, and is not intended to mean that the present invention falls within the purview of the related art that is already known to those skilled in the art.

BRIEF SUMMARY

The present disclosure has been made in an effort to solve the above-mentioned problem, and an object of the present disclosure is to provide an integrated water pump and valve device in which a water pump and a valve are integrally controlled by a single controller, and the water pump and the valve are integrated, thereby reducing an overall size.

To achieve the above-mentioned object, the present disclosure provides an integrated water pump and valve device including: a pump module configured to pump a coolant to allow the coolant to flow; a valve module disposed at a lateral side of the pump module, connected to the pump module to allow the coolant to flow, and configured to switch a flow direction of the coolant to one or more paths; and a control module configured to cover the pump module and the valve module and control a pumping operation of the pump module and a flow direction switching operation of the valve module.

The control module may include: a control housing including a pump covering part configured to cover the pump module, and a valve covering part configured to cover the valve module; and a controller embedded in the control housing, electrically connected to the pump module and the valve module, and configured to transmit a control signal to the pump module and the valve module.

The valve module may include: a valve housing coupled to the valve covering part and having a plurality of flow ports formed on an outer peripheral surface thereof; and a valve embedded in the valve housing and having an opening hole formed in an outer peripheral surface thereof, the opening hole being matched with the flow port to form a flow path in accordance with a rotation position.

The valve module may further include a valve drive part installed in the valve covering part, connected to a rotary shaft extending from an axial center of the valve, and configured to switch a rotation position of the valve in response to a control signal of the controller.

A shaft sealing part may be provided on the valve covering part and configured to surround the rotary shaft to seal a gap between the valve covering part and the rotary shaft, and the shaft sealing part may have an X-shaped cross-section.

A portion of the valve housing, which faces the valve covering part, may be opened, the valve housing may have therein a valve space in which the valve is provided, and the valve housing may have therein a sealing space recessed from the valve space toward the flow port and having a valve sealing part.

The valve sealing part may include: a contact portion having a communication hole matched with the flow port, one end being in contact with the valve, and a recessed groove formed in a circumferential direction at the other end thereof; and a sealing portion provided in the recessed groove to seal a gap between the contact portion and the valve housing and having an X-shaped cross-section.

The valve may have a protruding portion formed at a side opposite to a rotary shaft and disposed on the same line as the rotary shaft, and a support groove portion, into which the protruding portion of the valve is inserted, may be formed in the valve housing and support the valve.

The flow ports may include a plurality of output ports and an input port connected to communicate with the pump module, and the input port and each of the output ports may be disposed to be spaced apart from each other along an outer peripheral surface of the valve housing.

The input port and each of the output ports may be disposed on the outer peripheral surface of the valve housing and spaced apart from each other while defining an obtuse angle.

The opening holes may be disposed in the outer peripheral surface of the valve and spaced apart from one another while defining an obtuse angle, and an internal flow path passing through each of the opening holes may extend curvedly.

The pump module may have an inlet port and an outlet port through which the coolant is allowed to flow by the pumping operation, and the outlet port may be fitted with the input port.

The input port may have an inlet portion into which the outlet port is inserted, and a flange portion extending at the periphery of the inlet portion and having a fitting hole, and the outlet port may have a catching portion that is inserted into and fastened to the fitting hole of the flange portion when the outlet port is inserted into the inlet portion.

A drain part may be formed on the valve covering part of the control housing and externally communicate with a portion penetrated by a rotary shaft extending from an axial center of a valve.

The integrated water pump and valve device may further include: an adapter interposed between the valve covering part of the control housing and the valve module and configured to support a rotation of a valve.

The adapter may have a support portion mounted on the valve covering part and the valve module and configured to seal the valve covering part and the valve module and be in contact with the valve to support the rotation of the valve, and a through-hole may be formed in the support portion and penetrated by a rotary shaft extending from an axial center of the valve.

Bypass flow paths may be radially formed in the support portion from the through-hole, and each of the bypass flow paths may be connected to a drain flow path that communicates with the outside.

According to the integrated water pump and valve device structured as described above, the water pump and the valve are integrally controlled by the single controller, and the water pump and the valve are integrated, thereby reducing the overall size.

DETAILED DESCRIPTION

Hereinafter, an integrated water pump and valve device according to an exemplary embodiment of the present disclosure will be described with reference to the accompanying drawings.

Figure 1:
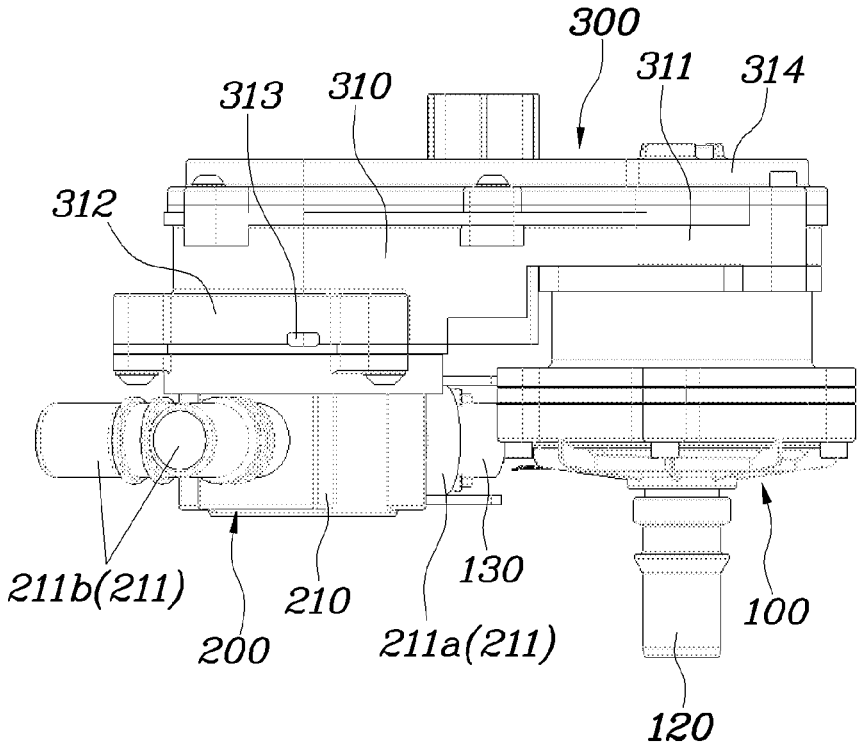
FIG. 1 is a view illustrating an integrated water pump and valve device according to the present disclosure.
Figure 2:
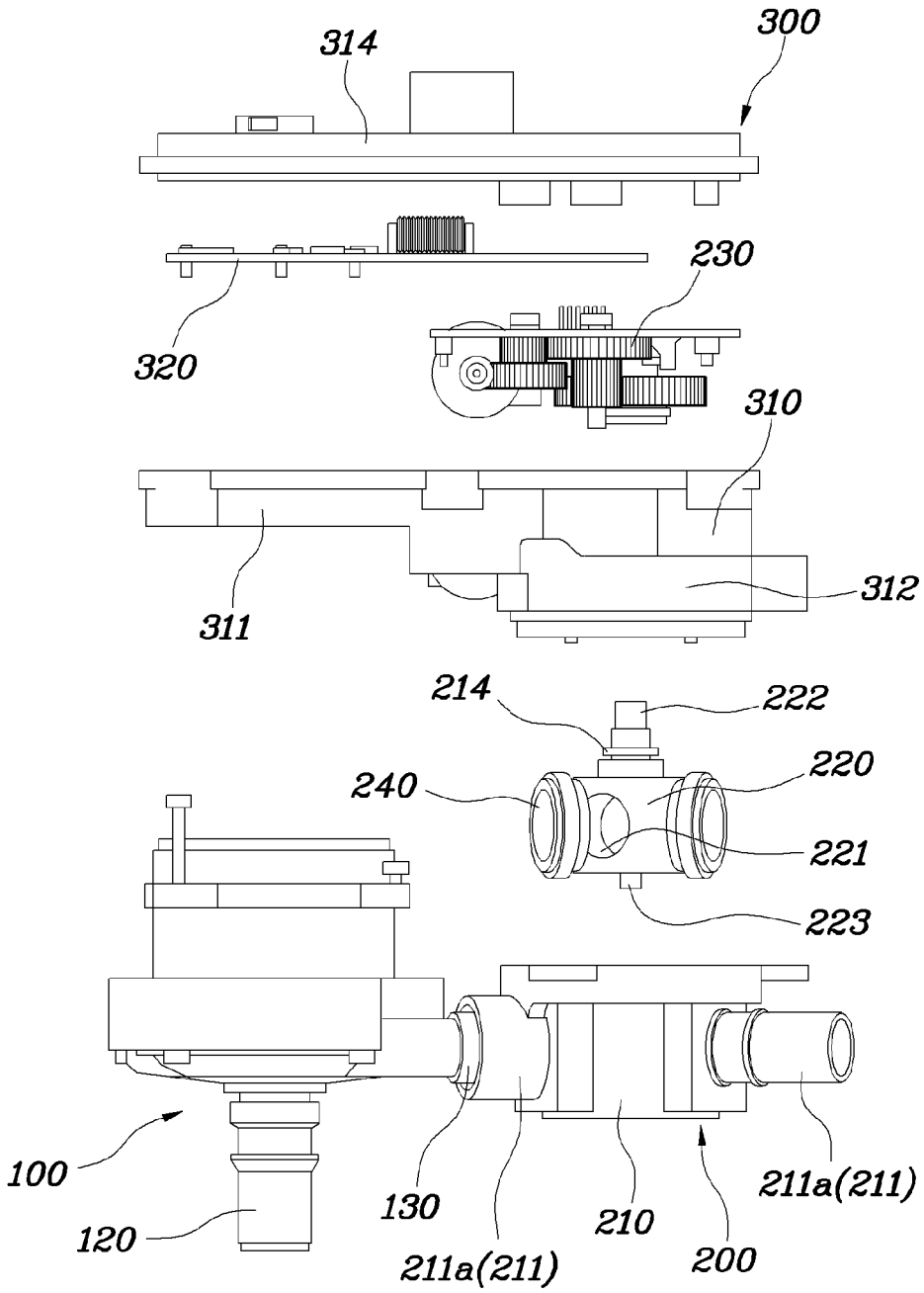
FIG. 2 is an assembled view of the integrated water pump and valve device illustrated in FIG. 1.
Figure 7:
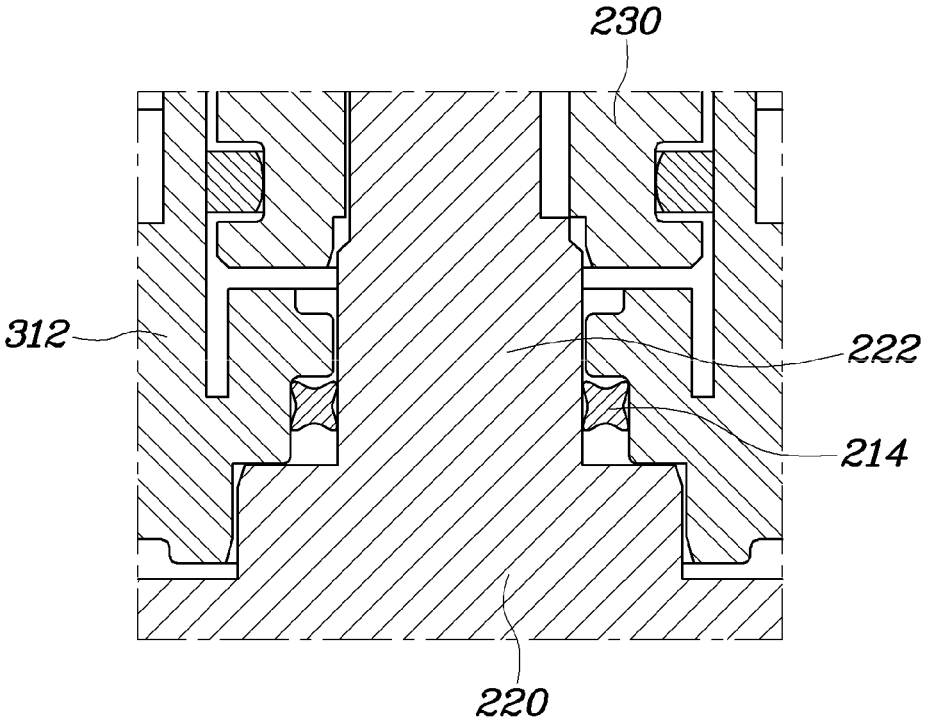
FIG. 7 is a view illustrating a valve sealing structure of the integrated water pump and valve device illustrated in FIG. 1.
Figure 8:
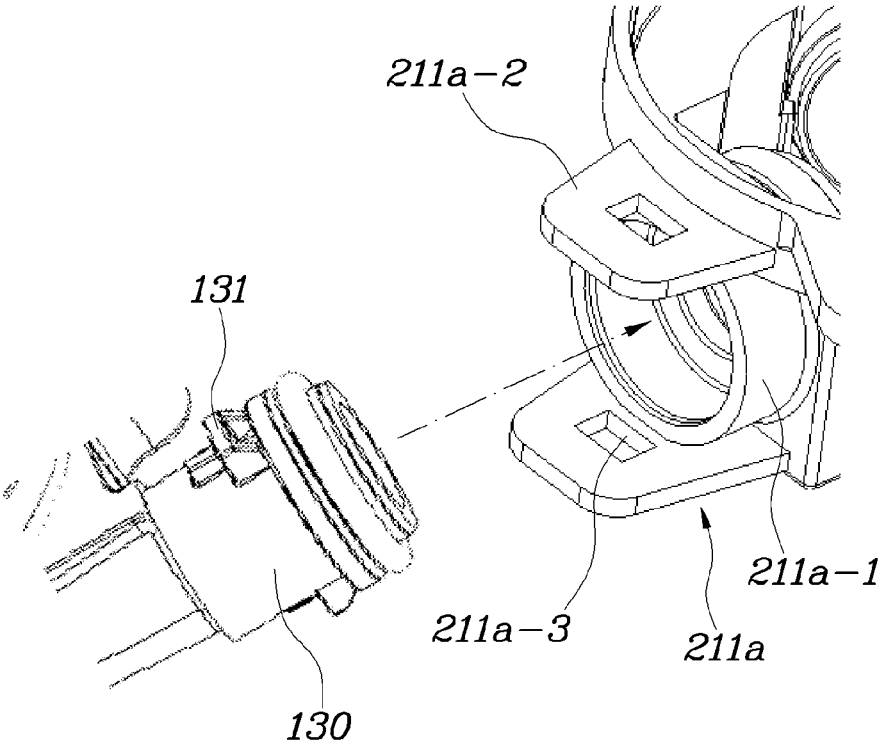
FIG. 8 is a view illustrating a connection structure between an outlet port and an input port of the integrated water pump and valve device illustrated in FIG. 1.
Figure 9:
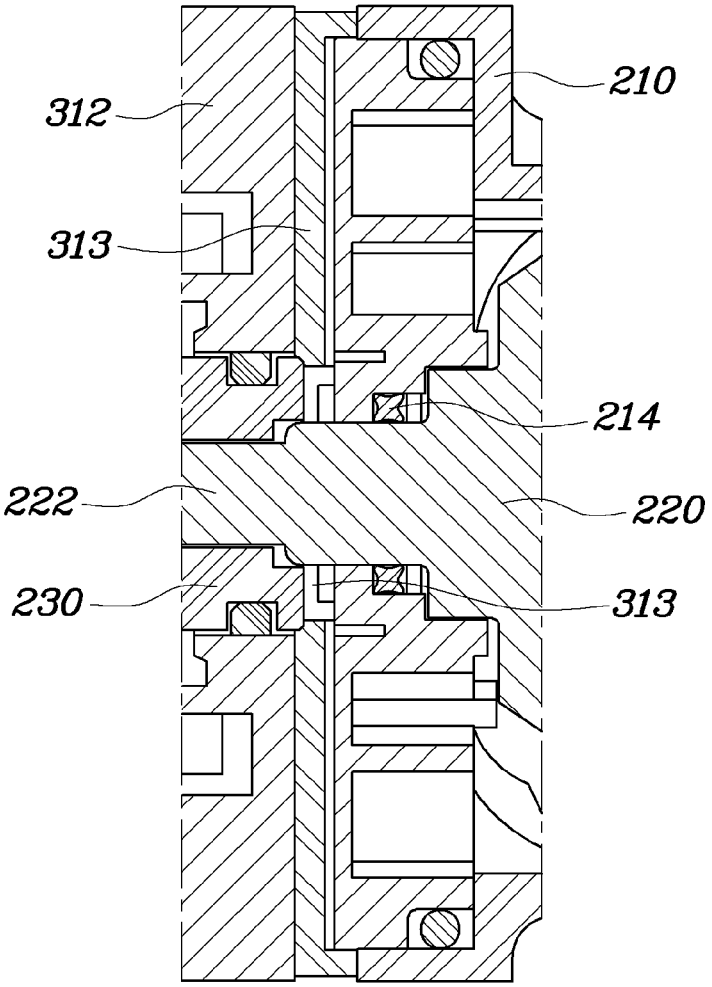
FIG. 9 is a view for explaining a drain part according to the present disclosure.
Figure 10:
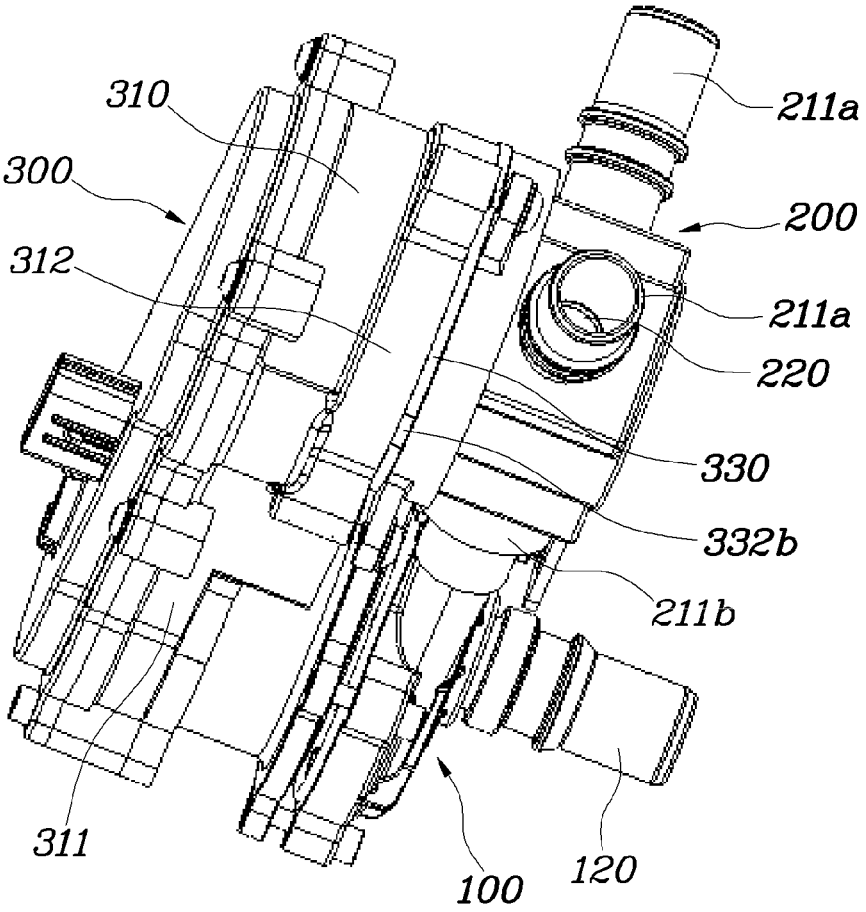
FIG. 10 is a view illustrating the valve module, a control module, and an adapter according to the present disclosure.
Figure 11:
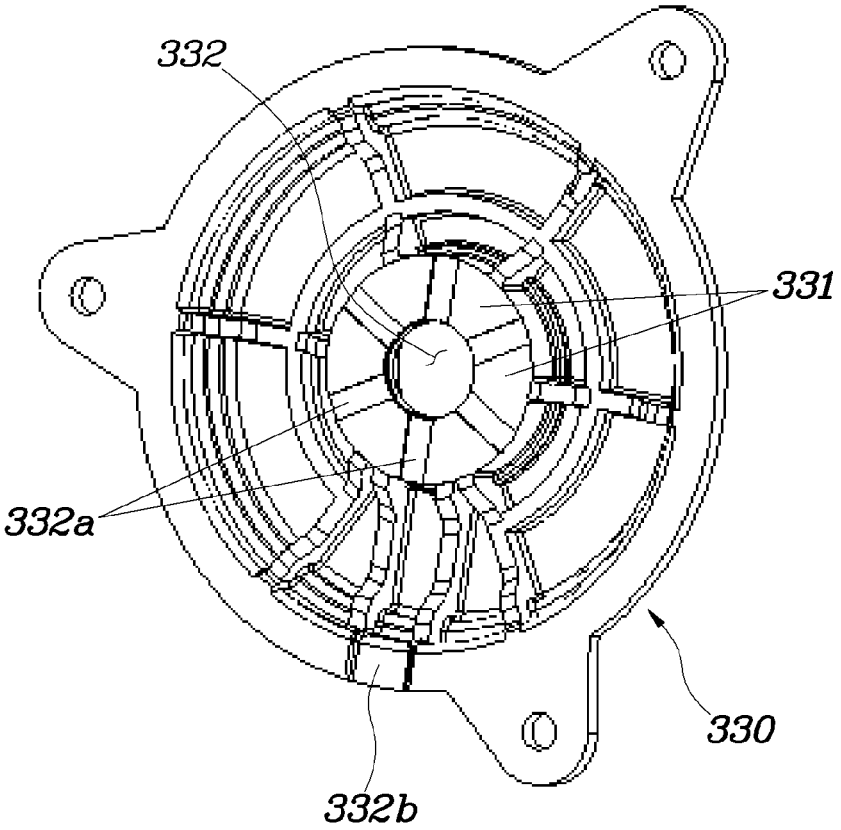
FIG. 11 is a view illustrating the adapter according to the present invention.
Figure 12:
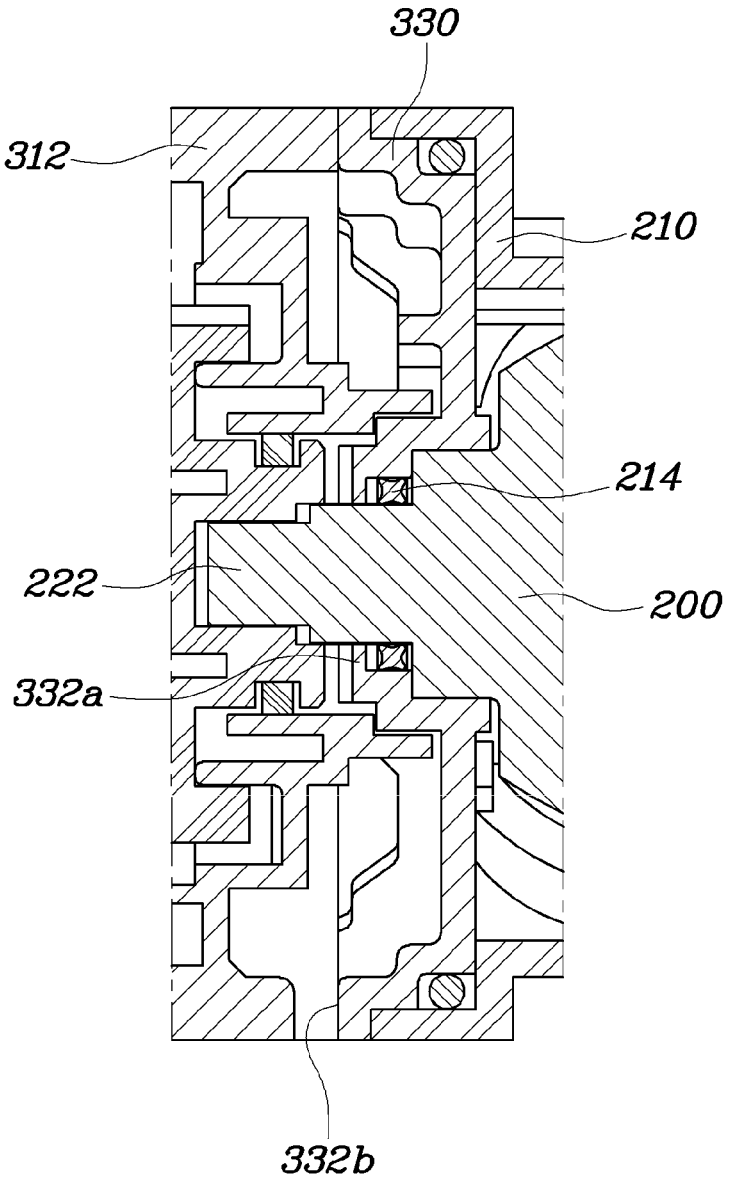
FIG. 12 is a view illustrating a drain flow path of the adapter according to the present invention.

FIG. 1 is a view illustrating an integrated water pump and valve device according to the present invention, FIG. 2 is an assembled view of the integrated water pump and valve device illustrated in FIG. 1, FIGS. 3 to 8 are views for explaining the integrated water pump and valve device illustrated in FIG. 1, FIG. 9 is a view for explaining a drain part of a control housing, and FIGS. 10 to 12 are views for explaining the integrated water pump and valve device to which an adapter is applied.

Figure 3:
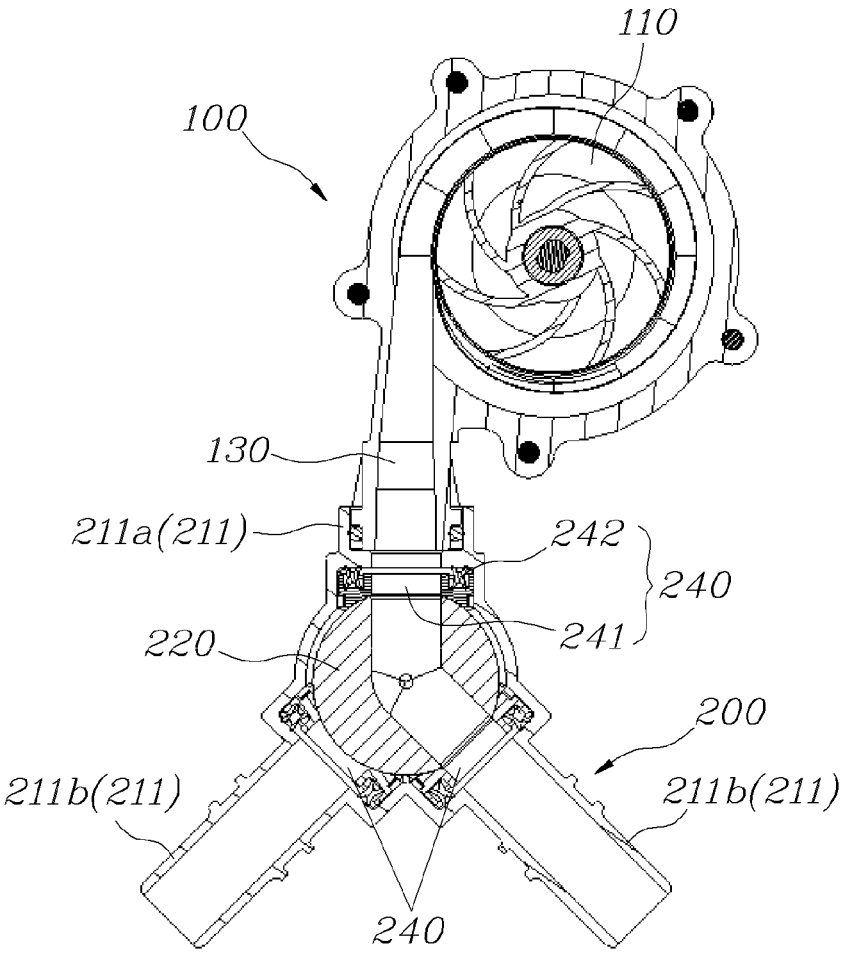
FIG. 3 is a view illustrating an interior of a pump module and an interior of a valve module of the integrated water pump and valve device illustrated in FIG. 1.

As illustrated in FIGS. 1 to 3, the integrated water pump and valve device according to the present invention includes a pump module 100 configured to pump a coolant and allow the coolant to flow, a valve module 200 disposed at a lateral side of the pump module 100, connected to the pump module 100 to allow the coolant to flow, and configured to switch a flow direction of the coolant to one or more paths, and a control module 300 configured to cover the pump module 100 and the valve module 200 and control a pumping operation of the pump module 100 and a flow direction switching operation of the valve module 200.

The pump module 100 has a blade 110 provided therein, and the coolant is pumped by a rotation of the blade 110. The pump module 100 has an inlet port 120 and an outlet port 130, and the coolant is allowed to flow from the inlet port 120 to the outlet port 130 by the pumping operation.

The valve module 200 is provided at the lateral side of the pump module 100 and allows the coolant to flow from the pump module 100. The valve module 200 switches the flow direction of the coolant, which flows from the pump module 100, to one or more paths. Although not illustrated in the drawings, coolant lines, which pass through various types of cooling system components, may be connected to the valve module 200 so that the coolant may flow to the coolant lines.

In this manner, the pump module 100 and the valve module 200 are disposed adjacent to each other in a lateral direction and controlled by the single control module 300. That is, the control module 300 is configured to cover the pump module 100 and the valve module 200, and the pump module 100 and the valve module 200 are mounted on the control module 300. Therefore, the pumping operation of the pump module 100 and the flow direction switching operation of the valve module 200 are integrally controlled by the single control module 300, which reduces manufacturing costs. In addition, the pump module 100, the valve module 200, and the control module 300 are modularized, such that an overall size is reduced, and an advantageous layout is obtained.

Hereinafter, the present invention will be specifically described.

As illustrated in FIG. 2, the control module 300 includes a control housing 110 having a pump covering part 311 configured to cover the pump module 100 and a valve covering part 312 configured to cover the valve module 200, and a controller 120 embedded in the control housing 310, electrically connected to the pump module 100 and the valve module 200, and configured to transmit a control signal to the pump module 100 and the valve module 200.

The control housing 310 has an opening side opposite to a side at which the pump module 100 and the valve module 200 are mounted, and a valve drive part 230, a controller 320, and various types of components, which will be described below, may be installed through the opening side. A cover 314 may be mounted at the opening side of the control housing 310, such that the opening side may be closed. In addition, the pump covering part 311 is formed at one side of the control housing 310, and the pump module 100 is mounted on the control housing 310 by means of the pump covering part 311. The valve covering part 312 is formed at the other side of the control housing 310, and the valve module 200 is mounted on the control housing 310 by means of the valve covering part 312. In this case, the pump covering part 311 and the valve covering part 312 may be formed to respectively surround the pump module 100 and the valve module 200 and have therein sealing rings for ensuring sealability.

Meanwhile, the controller 320 is provided in the control housing 310 and electrically connected to the pump module 100 and the valve module 200. The controller 320 is a PCB and controls the pumping operation of the pump module 100 and the flow direction switching operation of the valve module 200 in accordance with the amount of circulating coolant, a flow direction of the coolant, a flow rate of the coolant, and the like.

Figure 4:
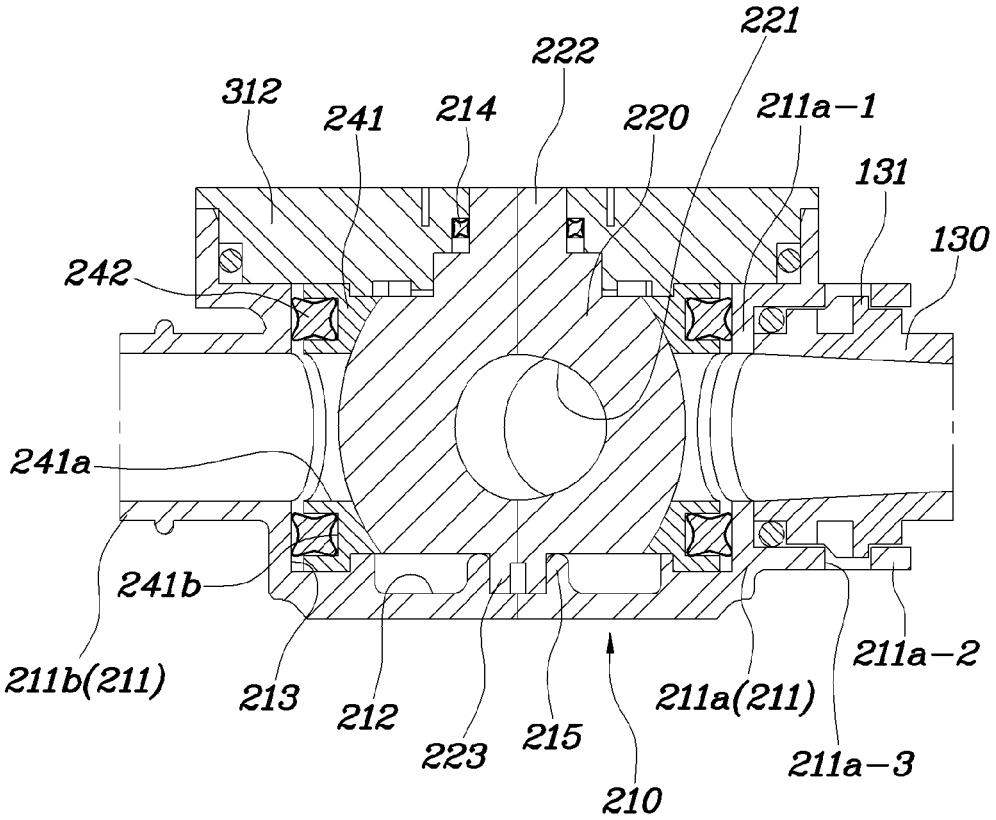
FIG. 4 is a cross-sectional view of the interior of the valve module of the integrated water pump and valve device illustrated in FIG. 1.

As illustrated in FIGS. 3 and 4, the valve module 200 includes a valve housing 210 coupled to the valve covering part 312 and having a plurality of flow ports 211 formed in an outer peripheral surface thereof; and a valve 220 embedded in the valve housing 210 and having an opening hole 221 formed in an outer peripheral surface thereof and configured to be matched with the flow port 211 in accordance with a rotation position to define a flow path.

As described above, the valve module 200 includes the valve housing 210 and the valve 220. When the valve 220 provided in the valve housing 210 rotates, the opening hole 221 of the valve 220 and the flow port 211 of the valve housing 210 are matched, such that the flow path is formed through the corresponding opening hole 221 and the flow port 211, and the coolant flows.

In this case, the flow ports 211 of the valve housing 210 may be formed to be larger in number than the opening holes 221 of the valve 220, such that the opening hole 221 may selectively communicate with the particular flow port 211 in accordance with the rotation position of the valve 220. In addition, the opening hole 221 may be formed through the valve 220 so that the opening hole 221 is connected to the interior of the valve 220 to define the flow path. Therefore, the flow direction of the coolant may be switched in accordance with the position of the valve 220.

Specifically, a portion of the valve housing 210, which faces the valve covering part 312, is opened. The valve housing 210 has therein a valve space 212 in which the valve 220 is provided. The valve housing 210 has a sealing space 213 disposed in the valve space 212 and recessed toward the flow port 211. The valve housing 210 has a valve sealing part 240.

Figure 5:
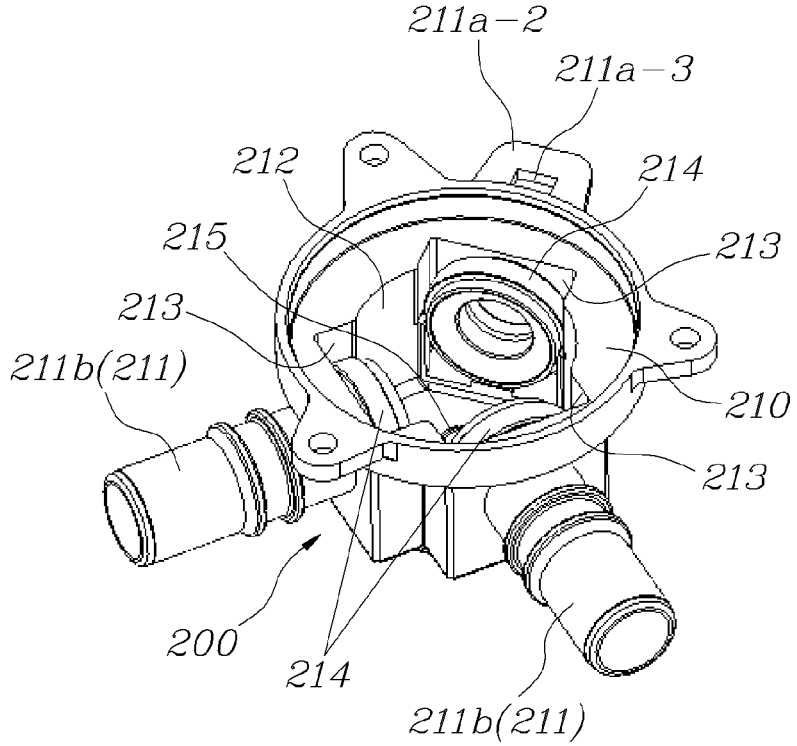
FIG. 5 is a view illustrating the interior of the valve module of the integrated water pump and valve device illustrated in FIG. 1.

As illustrated in FIG. 5, the valve space 212 and the sealing space 213 may be formed in the valve housing 210, such that the valve 220 and the valve sealing part 240 may be provided in the valve housing 210. In this case, the valve space 212 may be formed in a cylindrical shape in accordance with an external shape of the valve 220, and the sealing space 213 is formed from the valve space 212 toward the flow port 211. In addition, because the portion of the valve housing 210, which faces the valve covering part 312, is opened, the valve sealing part 240 may be mounted in the sealing space 213 through the opened portion, and the valve 220 may be mounted in the valve space 212 through the opened portion. As described above, the valve 220 and the valve sealing part 240 are mounted in the valve housing 210, and then the valve housing 210 is mounted on the valve covering part 312, such that the opened portion of the valve housing 210 may be closed, and the valve module 200 may be coupled to the control module 300. In addition, the valve sealing part 240 is compressed when the valve 220 is mounted in the valve space 212 in the state in which the valve sealing part 240 is mounted in the sealing space 213 of the valve housing 210, such that the sealing performance is ensured, and the assembling properties are improved.

Figure 6:
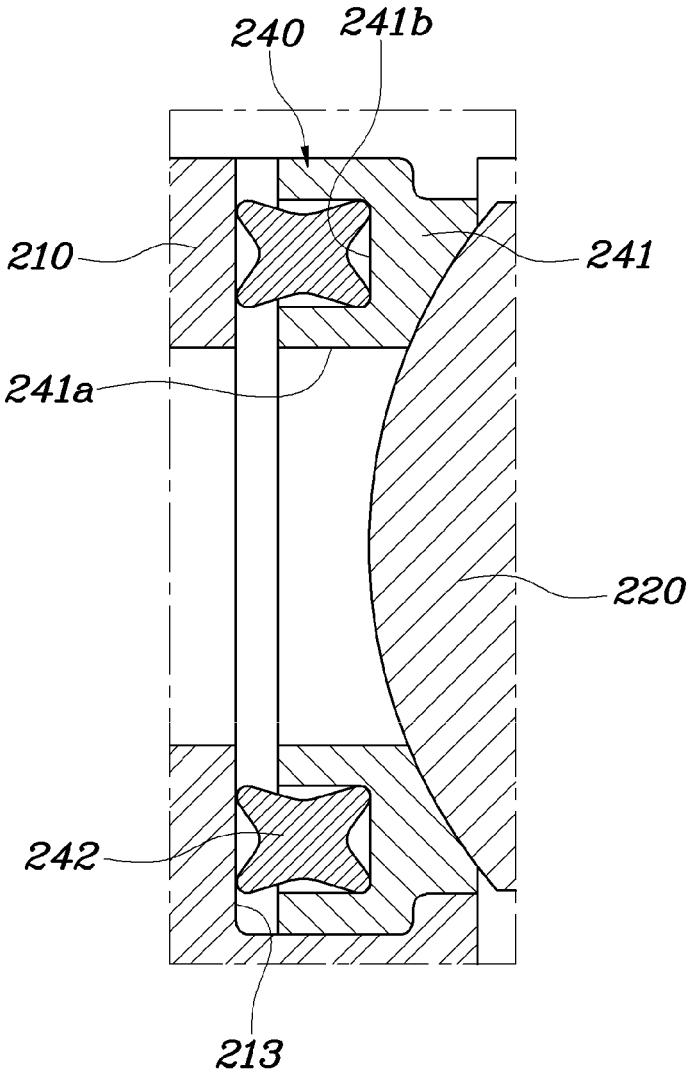
FIG. 6 is a view illustrating a valve sealing part of the integrated water pump and valve device illustrated in FIG. 1.

Meanwhile, as illustrated in FIG. 6, the valve sealing part 240 includes a contact portion 241 having a communication hole 241*a* matched with the flow port 211, having one end being in contact with the valve 220, having a recessed groove 241*b* formed in a circumferential direction at the other end thereof, and a sealing portion 242 provided in the recessed groove 241*b* to seal a gap between the contact portion 241 and the valve housing 210 and having an X-shaped cross-section.

As described above, the valve sealing part 240 includes the contact portion 241 and the sealing portion 242. The contact portion 241 may be made of a Teflon material, and the sealing portion 242 may be made of a rubber material. In this case, one end of the contact portion 241 is in contact with the valve 220. One end of the contact portion 241 may be formed in a curved shape in accordance with an external shape of the valve 220 and thus be in close contact with the valve 220. In addition, the recessed groove 241*b*, into which the sealing portion 242 is inserted, is formed at the other end of the contact portion 241, and the sealing portion 242 is provided in the recessed groove 241*b*. Therefore, the valve sealing part 240 is configured such that the contact portion 241 is in close contact with the valve 220, and the sealing portion 242 fixed to the contact portion 241 is in contact with the valve housing 210, such that the valve housing 210 and the valve 220 are sealed. In particular, because the sealing portion 242 is formed to have an X-shaped cross-section, the contact portion between the contact portion 241 and the valve housing 210 is minimized, thereby reducing friction. In addition, when hydraulic pressure is applied as the coolant flows toward the sealing portion 242, two opposite ends of the X-shape are spread, and a close-contact force between the valve housing 210 and the contact portion 241 increases, thereby improving the sealing performance.

Meanwhile, as illustrated in FIG. 4, the valve 220 has a protruding portion 223 formed at a side opposite to a rotary shaft 222 and disposed on the same line as the rotary shaft 222. A support groove portion 215, into which the protruding portion 223 of the valve 220 is inserted, is formed in the valve housing 210 and supports the valve 220. Therefore, the rotary shaft 222 of the valve 220 is rotatably supported on the valve covering part 312. The protruding portion 223 disposed to be opposite to the rotary shaft 222 is rotatably supported by the support groove portion 215 of the valve housing 210, such that the position of the valve 220 is stably fixed, and the operating performance according to the rotation is ensured. In this case, a portion of the valve housing 210, which faces the valve 220, has a cross-section protruding toward the valve 220 and supports the valve 220, and the support groove portion 215 is formed in the protruding portion. Therefore, the protruding portion 223 of the valve 220 is inserted into the support groove portion 215, such that the installation of the valve 220 is stabilized. In addition, the rotary shaft 222 and the protruding portion 223 of the valve 220 are formed on the same line, the axial rotation of the valve 220 is stabilized.

Meanwhile, the valve module 200 further includes a valve drive part 230 installed in the valve covering part 312, and connected to the rotary shaft 222 extending from an axial center of the valve 220, and configured to switch a rotation position of the valve 220 in response to a control signal of the controller 320.

The valve drive part 230 generates power to rotate the valve 220. The valve drive part 230 is installed in the valve covering part 312 of the control module 300 and connected to the rotary shaft 222 of the valve 220. The valve drive part 230 determines a rotation position of the valve 220 in response to the control signal of the controller 320. When the valve drive part 230 rotates the rotary shaft 222, the valve 220 rotates, such that the opening hole 221 of the valve 220 is matched with the particular flow port 211 of the valve housing 210.

Meanwhile, as illustrated in FIG. 7, a shaft sealing part 214 is provided in the valve covering part 312 and seals a gap between the valve covering part 312 and the rotary shaft 222 while surrounding the rotary shaft 222. The shaft sealing part 214 has an X-shaped cross-section. As described above, the shaft sealing part 214 is in close contact with the valve covering part 312 and the rotary shaft 222 of the valve 220 and seals a gap between the valve covering part 312 and the rotary shaft 222, thereby preventing the coolant in the valve housing 210 from flowing toward the control module 300. In particular, because the shaft sealing part 214 is formed in an X-shape, the contact portion with the rotary shaft 222 of the valve 220 is minimized, thereby reducing friction. In addition, when hydraulic pressure is applied as the coolant flows toward the shaft sealing part 214, two opposite ends of the X-shape are spread, and a close-contact force between the valve covering part 312 and the rotary shaft 222 increases, thereby improving the sealing performance.

Meanwhile, the flow ports 211 include a plurality of output ports 211*b* and an input port 211*a* connected to communicate with the pump module 100. The input port 211*a* and each of the output ports 211*b* are disposed to be spaced apart from each other along an outer peripheral surface of the valve housing 210.

As illustrated in FIG. 3, the flow ports 211 including the input port 211*a* and the plurality of output ports 211*b* are formed in the outer peripheral surface of the valve housing 210. The input port 211*a* may be connected to the inlet port 120 of the pump module 100, and the output ports 211*b* may be respectively connected to the coolant lines passing through various types of cooling system components. Therefore, the coolant pumped from the pump module 100 may be introduced into the input port 211*a* and flow through the particular output port 211*b*, among the plurality of output ports 211*b*, in accordance with the rotation position of the valve 220.

In this case, the input port 211*a* and each of the output ports 211*b* are disposed on the outer peripheral surface of the valve housing 210 and spaced apart from each other while defining an obtuse angle.

In addition, the opening holes 221 are disposed in the outer peripheral surface of the valve 220 and spaced apart from one another while defining obtuse angles, internal flow paths passing through the opening holes 221 extend curvedly.

As described above, an angle at which the input port 211*a* and each of the output ports 211*b* are spaced apart from each other is defined as an obtuse angle, and an angle at which the opening holes 221 of the valve 220 are spaced apart from one another is defined as an obtuse angle, such that the coolant may flow when the opening hole 221 of the valve 220 is matched with the input port 211*a* and each of the output ports 211*b*. In particular, the input port 211*a* and each of the output ports 211*b* are disposed to be spaced apart from each other while defining an obtuse angle, thereby reducing flow resistance caused when the coolant introduced through the input port 211*a* rapidly turns toward the output port 211*b*. Further, the opening holes 221 are also disposed in the outer peripheral surface of the valve 220 and spaced apart from one another while defining an obtuse angle, and the internal flow path passing through each of the opening holes 221 extends curvedly, such that the flow resistance of the coolant introduced through the opening hole 221 is reduced.

Meanwhile, in the pump module 100, the outlet port 130 is detachably fitted with the input port 211*a*, such that the pump module 100 and the valve module 200 are simply assembled.

To this end, the input port 211*a* has an inlet portion 211*a*-1 into which the outlet port 130 is inserted, and a flange portion 211*a*-2 extending at the periphery of the inlet portion and having a fitting hole 211*a*-3. The outlet port 130 has a catching portion 131 that is inserted into and fastened to the fitting hole 211*a*-3 of the flange portion 211*a*-2 when the outlet port 130 is inserted into the inlet portion 211*a*-1.

As illustrated in FIGS. 4 and 8, the input port 211*a* has the inlet portion 211*a*-1 that communicates with the interior of the valve housing 210, such that the path, through which the coolant flows, is formed when the outlet port 130 of the pump module 100 is inserted into the inlet portion 211*a*-1. In addition, the flange portion 211*a*-2 extends from the input port 211*a* at the periphery of the inlet portion 211*a*-1 in an insertion direction of the outlet port 130. The flange portion 211*a*-2 may be provided as a pair of flange portions 211*a*-2 symmetrically disposed based on the inlet portion 211*a*-1. The catching portion 131 may be formed on the outlet port 130 and inserted into the fitting hole 211*a*-3 of the flange portion 211*a*-2. The catching portions 131 may be equal in number to the flange portions 211*a*-2 and matched with the flange portions 211*a*-2. Therefore, when the outlet port 130 is inserted into the inlet portion 211*a*-1, the catching portion 131 is inserted into and fastened to the fitting hole 211*a*-3 of the flange portion 211*a*-2, such that the outlet port 130 may be robustly fastened to the input port 211*a*. In addition, the flange portion 211*a*-2 is made of a plastic material and may be deformed. In case that the outlet port 130 is pushed into the inlet portion 211*a*-1, the flange portions 211*a*-2 may be deformed while being spread. When the catching portion 131 is inserted into the fitting hole 211*a*-3, the shape is restored, such that the fastened state may be maintained.

Meanwhile, as illustrated in FIGS. 1 and 9, a drain part 113 is formed on the valve covering part 312 of the control housing 310 and externally communicates with a portion penetrated by the rotary shaft 222 extending from the axial center of the valve 220. In this case, the drain part 313 is formed to be farther from the valve 220 than the shaft sealing part 214 provided on the valve covering part 312. The drain part 313 has a space larger in width than the rotary shaft 222 of the valve 220 in the valve covering part 312, and the corresponding space communicates with the outside. Therefore, a small amount of coolant partially leaking through the rotary shaft 222 of the valve 220 remains on the drain part 313, and the remaining coolant flows to the outside through the drain part 313. As described above, in case that a small amount of coolant leaks through the rotary shaft 222, the coolant flows to the outside through the drain part 313 formed on the valve covering part 312, thereby preventing damage to the component caused when the coolant is introduced into the valve drive part 230.

Meanwhile, as another embodiment, as illustrated in FIGS. 10 to 12, an adapter 130 is further provided to be disposed between the valve covering part 312 of the control housing 310 and the valve module 200 and supports the rotation of the valve 220. That is, the adapter 330 is formed to cover the valve housing 210 of the valve module 200 and coupled to the valve covering part 312 together with the valve module 200. In addition, a portion of the adapter 330, which faces the valve 220, may be formed to be in contact with the valve 220, thereby fixing the position of the valve 220 and allowing the valve 220 to stably rotate.

Specifically, the adapter 330 has a support portion 131 mounted on the valve covering part 312 and the valve module 200 and configured to seal the valve covering part 312 and the valve module 200 and be in contact with the valve 220 to support the rotation of the valve 220. A through-hole 332 is formed in the support portion 331 and penetrated by the rotary shaft 222 extending from the axial center of the valve 220. In this case, a separate sealing ring may be provided on a rim of the adapter 330 and mounted to seal the valve module 200. In addition, the protruding support portion 331 is formed so that the portion of the adapter 330, which faces the valve 220, is in contact with the valve 220, and the support portion 331 surrounds the end of the valve 220, such that the valve 220 is supported to be stably rotated. The support portion 331 may have the through-hole 332 penetrated by the rotary shaft 222 of the valve 220, and the shaft sealing part 214 may be provided on the portion of the support portion 331 where the through-hole 332 is formed.

In addition, bypass flow paths 332*a* are radially formed in the support portion 331 from the through-hole 332, and each of the bypass flow paths 332*a* is connected to a drain flow path 332*b* that communicates with the outside. As described above, the bypass flow paths 332*a* are formed in the support portion 331 from the through-hole 332, such that a small amount of coolant, which partially leaks through the rotary shaft 222, flows to the bypass flow path 332*a*, and the coolant, which flows to the bypass flow path 332*a*, flows to the outside through the drain flow path 332*b*. Therefore, in case that a small amount of coolant leaks through the rotary shaft 222, the coolant flows to the outside through the bypass flow path 332*a* and the drain flow path 332*b* formed on the adapter 330, thereby preventing damage to the component caused by the introduction of the coolant toward the valve drive part 230.

According to the integrated water pump and valve device structured as described above, the water pump and the valve are integrally controlled by the single controller, and the water pump and the valve are integrated, thereby reducing the overall size.

While the specific embodiments of the present invention have been illustrated and described, it will be obvious to those skilled in the art that the present invention may be variously modified and changed without departing from the technical spirit of the present invention defined in the appended claims.

[Description of Reference Numerals]

| | |
|---|---|
| 100: Pump module | 110: Blade |
| 120: Inlet port | 130: Outlet port |
| 131: Catching portion | 200: Valve module |
| 210: Valve housing | 211: Flow port |
| 211a: Input port | 211a-1: Inlet portion |
| 211a-2: Flange portion | 211a-3: Fitting hole |
| 211b: Output port | 212: Valve space |
| 213: Sealing space | 214: Shaft sealing part |
| 215: Support groove portion | 220: Valve |
| 221: Opening hole | 222: Rotary shaft |
| 223: Protruding portion | 230: Valve drive part |
| 240: Valve sealing part | 241: Contact portion |
| 241a: Communication hole | 241b: Recessed groove |
| 242: Sealing portion | 300: Control module |

-continued

[Description of Reference Numerals]

| | |
|---|---|
| 310: Control housing | 311: Pump covering part |
| 312: Valve covering part | 313: Drain part |
| 320: Controller | 330: Adapter |
| 331: Support portion | 332: Through-hole |
| 332a: Bypass flow path | 332b: Drain flow path |

The invention claimed is:

1. An integrated water pump and valve device comprising:

a pump module configured to pump a coolant to allow the coolant to flow;

a valve module disposed at a lateral side of the pump module, connected to the pump module to allow the coolant to flow, and configured to switch a flow direction of the coolant to one or more paths; and a control module configured to cover the pump module and the valve module and control a pumping operation of the pump module and a flow direction switching operation of the valve module.

2. The integrated water pump and valve device of claim 1, wherein the control module comprises:

a control housing including a pump covering part configured to cover the pump module, and a valve covering part configured to cover the valve module; and a controller embedded in the control housing, electrically connected to the pump module and the valve module, and configured to transmit a control signal to the pump module and the valve module.

3. The integrated water pump and valve device of claim 2, wherein a drain part is formed on the valve covering part of the control housing and externally communicates with a portion penetrated by a rotary shaft extending from an axial center of a valve.

4. The integrated water pump and valve device of claim 2, further comprising:

an adapter interposed between the valve covering part of the control housing and the valve module and configured to support a rotation of a valve.

5. The integrated water pump and valve device of claim 4, wherein the adapter has a support portion mounted on the valve covering part and the valve module and configured to seal the valve covering part and the valve module and be in contact with the valve to support the rotation of the valve, and a through-hole is formed in the support portion and penetrated by a rotary shaft extending from an axial center of the valve.

6. The integrated water pump and valve device of claim 5, wherein bypass flow paths are radially formed in the support portion from the through-hole, and each of the bypass flow paths is connected to a drain flow path that communicates with the outside.

7. The integrated water pump and valve device of claim 2, wherein the valve module comprises:

a valve housing coupled to the valve covering part and having a plurality of flow ports formed on an outer peripheral surface thereof; and a valve embedded in the valve housing and having an opening hole formed in an outer peripheral surface thereof, the opening hole being matched with the flow port to form a flow path in accordance with a rotation position.

8. The integrated water pump and valve device of claim 7, wherein the valve has a protruding portion formed at a side opposite to a rotary shaft and disposed on the same line as the rotary shaft, and a support groove portion, into which the protruding portion of the valve is inserted, is formed in the valve housing and supports the valve.

9. The integrated water pump and valve device of claim 7, wherein the valve module further comprises a valve drive part installed in the valve covering part, connected to a rotary shaft extending from an axial center of the valve, and configured to switch a rotation position of the valve in response to a control signal of the controller.

10. The integrated water pump and valve device of claim 9, wherein a shaft sealing part is provided on the valve covering part and configured to surround the rotary shaft to seal a gap between the valve covering part and the rotary shaft, and the shaft sealing part has an X-shaped cross-section.

11. The integrated water pump and valve device of claim 7, wherein a portion of the valve housing, which faces the valve covering part, is opened, the valve housing has therein a valve space in which the valve is provided, and the valve housing has therein a sealing space recessed from the valve space toward the flow port and having a valve sealing part.

12. The integrated water pump and valve device of claim 11, wherein the valve sealing part comprises:

a contact portion having a communication hole matched with the flow port, one end being in contact with the valve, and a recessed groove formed in a circumferential direction at the other end thereof; and a sealing portion provided in the recessed groove to seal a gap between the contact portion and the valve housing and having an X-shaped cross-section.

13. The integrated water pump and valve device of claim 7, wherein the flow ports include a plurality of output ports and an input port connected to communicate with the pump module, and the input port and each of the output ports are disposed to be spaced apart from each other along an outer peripheral surface of the valve housing.

14. The integrated water pump and valve device of claim 13, wherein the input port and each of the output ports are disposed on the outer peripheral surface of the valve housing and spaced apart from each other while defining an obtuse angle.

15. The integrated water pump and valve device of claim 14, wherein the opening holes are disposed in the outer peripheral surface of the valve and spaced apart from one another while defining an obtuse angle, and an internal flow path passing through each of the opening holes extends curvedly.

16. The integrated water pump and valve device of claim 13, wherein the pump module has an inlet port and an outlet port through which the coolant is allowed to flow by the pumping operation, and the outlet port is fitted with the input port.

17. The integrated water pump and valve device of claim 16, wherein the input port has an inlet portion into which the outlet port is inserted, and a flange portion extending at the periphery of the inlet portion and having a fitting hole, and the outlet port has a catching portion that is inserted into and fastened to the fitting hole of the flange portion when the outlet port is inserted into the inlet portion.

* * * * *